US008656626B1

(12) United States Patent
McCamley

(10) Patent No.: US 8,656,626 B1
(45) Date of Patent: Feb. 25, 2014

(54) APPARATUS FOR HOLDING A GUN AND METHOD OF USE

(71) Applicant: Randall Ernest McCamley, Great Falls, MT (US)

(72) Inventor: Randall Ernest McCamley, Great Falls, MT (US)

( * ) Notice: Subject to any disclaimer, the term of this patent is extended or adjusted under 35 U.S.C. 154(b) by 0 days.

(21) Appl. No.: 13/666,478

(22) Filed: Nov. 1, 2012

Related U.S. Application Data

(60) Provisional application No. 61/632,562, filed on Jan. 26, 2012.

(51) Int. Cl.
*F41A 29/00* (2006.01)
*F41A 23/18* (2006.01)
*A47B 81/00* (2006.01)

(52) U.S. Cl.
CPC ..... *F41A 23/18* (2013.01); *A47B 81/00* (2013.01)
USPC ..... 42/94; 211/64; 248/176.1

(58) Field of Classification Search
CPC ..... F41A 23/18; A47B 81/00
USPC ..... 42/94; 211/64; 248/176.1
See application file for complete search history.

(56) References Cited

U.S. PATENT DOCUMENTS

| | | | | |
|---|---|---|---|---|
| 5,682,700 | A * | 11/1997 | Sandberg | 42/94 |
| 8,474,171 | B1 * | 7/2013 | Simmons | 42/95 |
| 2007/0170128 | A1 * | 7/2007 | Punzel | 211/64 |
| 2012/0222344 | A1 * | 9/2012 | Werner | 42/94 |

* cited by examiner

*Primary Examiner* — J. Woodrow Eldred
(74) *Attorney, Agent, or Firm* — Ted Masters

(57) ABSTRACT

An apparatus is disclosed for holding a gun, the apparatus cooperates with a support member. The gun has an upper receiver having an pivot pin lug, and a lower receiver having a pivot pin. The apparatus includes a support beam which has a proximal end and an opposite distal end. The proximal end of the support beam is connectable to the support member so that the support beam is horizontally cantilevered from the support member. An upper receiver attachment pin is connected to said support beam, the upper receiver attachment pin being shaped and dimensioned to connect to the pivot pin lug so that the upper receiver hangs from the upper receiver attachment pin. A lower receiver attachment lug is connected to the support beam, the lower receiver attachment lug is shaped an dimensioned to connect to the pivot pin.

24 Claims, 16 Drawing Sheets

Fig. 22
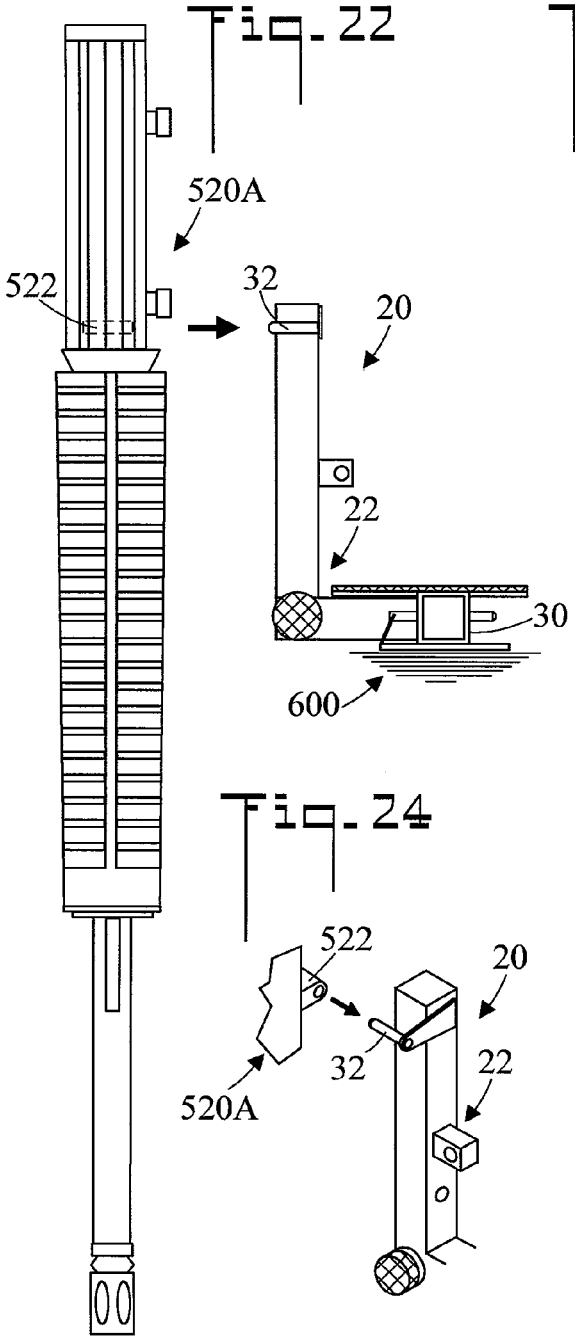
Fig. 23
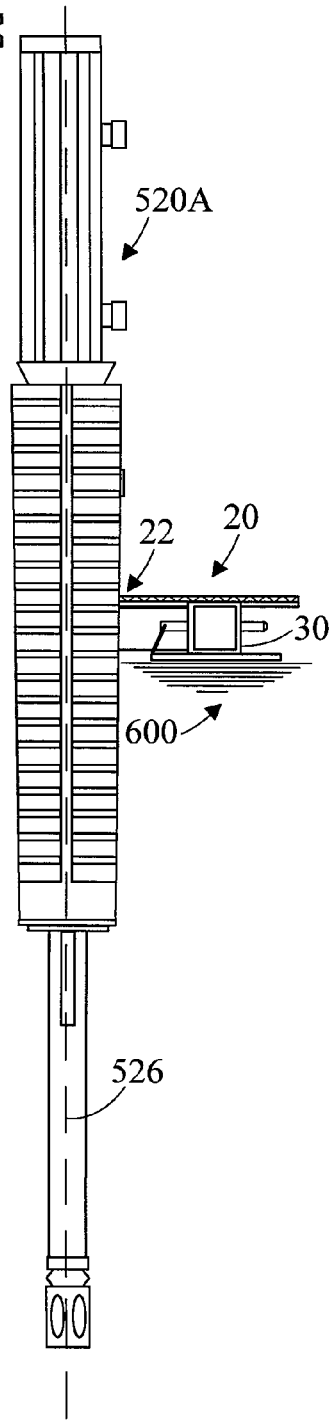
Fig. 24

520A
510A
52
20
30
600

APPARATUS FOR HOLDING A GUN AND METHOD OF USE

CROSS REFERENCE TO RELATED APPLICATION

This application claims the filing benefit under 35 U.S.C. §119(e) of U.S. Provisional Application No. 61/632,562 filed Jan. 26, 2012, which is hereby incorporated by reference.

TECHNICAL FIELD

The present invention pertains generally to guns, and more particularly to an apparatus which holds the gun during inspection, cleaning, and other maintenance activities.

BACKGROUND OF THE INVENTION

Devices which hold guns for the purpose of inspection, cleaning, and maintenance are known in the art. For rifle type guns these devices typically hold the entire gun including both buttstock and barrel. However, some "folding" guns, such as those of the M16/AR-15/M-4 type must be disassembled into upper and lower receiver assemblies in order to perform proper inspection, cleaning, and maintenance. As such, conventional gun holding devices cannot be used on these guns.

BRIEF SUMMARY OF THE INVENTION

The present invention is directed to apparatus for holding a gun. The apparatus allows folding type rifles such as the military M-16 and the civilian AR-15 and M-4 rifles to have the upper receiver assembly and the lower receiver assembly both held in the same device at the same time (or separately) for cleaning, inspection, maintenance, and light gunsmithing. The apparatus securely holds the upper receiver in a vertical barrel down position which facilitates clear and unobstructed access for cleaning and inspection of the chamber and bore area of the gun. This vertical position greatly improves the user's ability to inspect and clean these areas which are prone to carbon build up and other harmful residues. Additionally, in the vertical position gun cleaner solvents and other liquid solutions applied into the barrel have improved performance by flowing down (by gravity) the barrel of the gun thereby removing contaminates and other debris. The apparatus also holds the lower receiver in a horizontal position which is useful for inspection, cleaning, and maintenance. The two gun assemblies are held in the apparatus utilizing the gun's own features (the lower receiver pivot pin and the upper receiver pivot pin lug).

The apparatus is small, compact, and is easily portable which allows it to be taken to different location for use. In addition to mounting the apparatus to a table top or work bench, the apparatus can be mounted to any other surface or structure capable of supporting the weight of the gun (such as the tailgate of a pickup truck). An additional feature of the apparatus is that the upper receiver can be optionally placed and secured in a horizontally position. In the horizontal position additional light gunsmithing can be performed on the upper receiver.

In accordance with an embodiment, apparatus for holding a gun having an upper receiver having a pivot pin lug, includes a gun holder which includes a support beam having a proximal end and an opposite distal end, and an upper receiver attachment pin which is shaped and dimensioned to connect to the pivot pin lug. The proximal end of the support beam is connectable to a support member so that the support beam is horizontally cantilevered from the support member. When the support beam is connected to the support member and the pivot pin lug is connected to the upper receiver attachment pin, the upper receiver hangs barrel down from the upper receiver attachment pin.

In accordance with another embodiment, the gun holder includes an upper receiver bumper which abuts the upper receiver when the pivot pin lug is connected to the upper receiver attachment pin.

In accordance with another embodiment, the upper receiver has a longitudinal axis. The upper receiver bumper has an adjustable length, which when adjusted changes an angular position of the longitudinal axis of the upper receiver with respect to vertical.

In accordance with another embodiment, an anchor is connectable to the support member, the anchor is shaped and dimensioned to removably receive and hold the proximal end of the support beam.

In accordance with another embodiment, a strap holds the upper receiver to the gun holder.

In accordance with another embodiment, the upper receiver includes a takedown pin lug. The gun holder includes a second upper receiver attachment pin which is shaped and dimensioned to connect to the takedown pin lug, so that the pivot pin lug can be connected to the upper receiver attachment pin, and the takedown pin lug can be connected to the second upper receiver attachment pin, thereby holding the upper receiver in a horizontal position.

In accordance with another embodiment, the gun has a lower receiver having a pivot pin and a longitudinal axis. The gun holder includes a lower receiver attachment lug which is shaped an dimensioned to connect to the pivot pin.

In accordance with another embodiment, the gun holder includes a platform which horizontally supports the lower receiver when the pivot pin is connected to the lower receiver attachment lug, so that the longitudinal axis of the lower receiver is horizontally disposed.

In accordance with another embodiment, a first arm is connected to the distal end of the support beam, the first arm is disposed perpendicular to the support beam, the first arm has a distal end. A second arm is connected to the distal end of the first arm, the second arm is disposed perpendicular to the first arm and disposed perpendicular to the support beam.

In accordance with another embodiment, the upper receiver attachment pin is disposed on the second arm.

In accordance with another embodiment, a strap connects the upper receiver to the second arm.

In accordance with another embodiment, an upper receiver bumper abuts the upper receiver when the pivot pin lug is connected to the upper receiver attachment pin. The upper receiver bumper is disposed on the second arm.

In accordance with another embodiment, the lower receiver attachment lug is disposed on the second arm.

In accordance with another embodiment, a platform horizontally supports the lower receiver when the pivot pin is connected to the lower receiver attachment lug. The platform is disposed on the first arm.

In accordance with another embodiment, a swing arm has a proximal end and an opposite distal end. The proximal end is pivotally connected to the second arm, and the distal end includes a second upper receiver attachment pin.

Other embodiments, in addition to the embodiments enumerated above, will become apparent from the following detailed description, taken in conjunction with the accompanying drawings, which illustrate, by way of example, the principles of the apparatus and method of use.

BRIEF DESCRIPTION OF THE DRAWINGS

FIG. 22 is a front elevation view of the apparatus with the upper receiver positioned to be connected thereto;

FIG. 23 is a front elevation view of the apparatus with the upper receiver connected;

FIG. 24 is a fragmented perspective view of the upper receiver being connected to the apparatus;

DETAILED DESCRIPTION OF THE INVENTION

Figure 1:
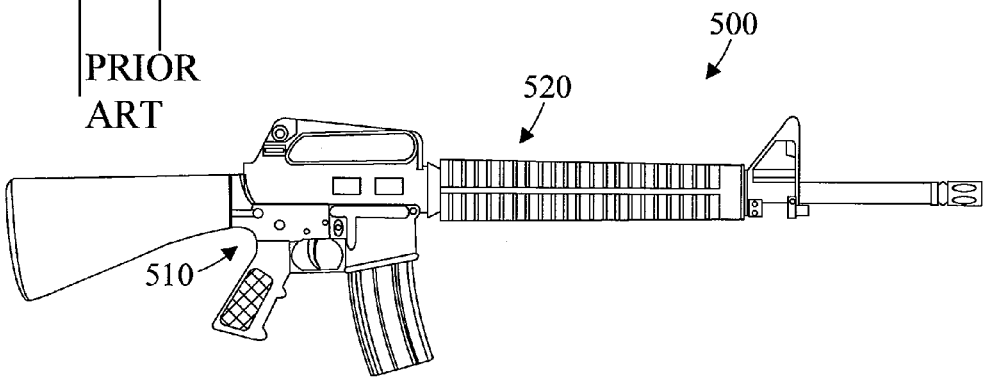
Fig. 1 PRIOR ART
FIG. 1 is a reduced side elevation view of a prior art gun.

Referring initially to FIG. 1, there is illustrated a reduced side elevation view of a prior art gun 500. As shown gun 500 is a folding rifle of the military M-16 or civilian AR-15/M-4 type. However, it is noted that the principles of the present invention could also be applied to other guns including other rifles and hand guns. In the shown embodiment, gun 500 includes a lower receiver and buttstock assembly 510 (refer to FIGS. 2-3) and an upper receiver and barrel assembly 520 (refer to FIGS. 4-6), both of which are comprised of numerous sub-elements.

Figure 2:
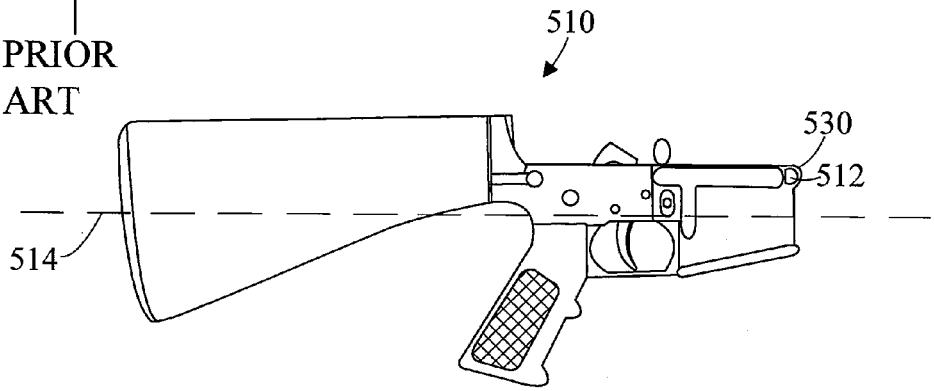
Fig. 2 PRIOR ART
FIG. 2 is a right side elevation view of a prior art lower receiver.
Figure 3:
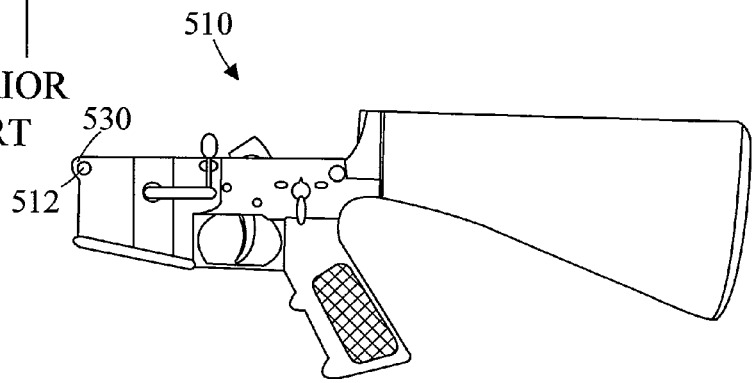
Fig. 3 PRIOR ART
FIG. 3 is a left side elevation view of the prior art lower receiver.
Figure 19:
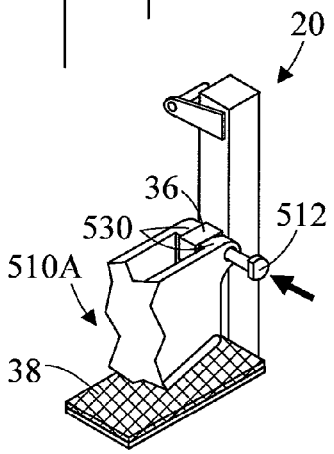
FIG. 19 is a fragmented perspective view of the lower receiver being connected to the apparatus.
Figure 20:
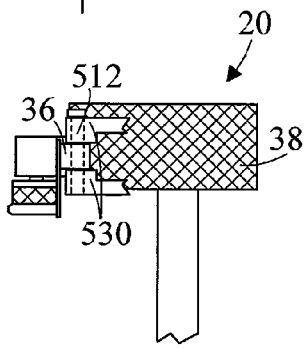
FIG. 20 is a fragmented top plan view of the lower receiver connected to the apparatus.

FIGS. 2-3 are right side elevation and left side elevation views respectively of lower receiver and buttstock assembly 510, which includes a pivot pin 512 which cooperates with two spaced apart lugs 530 (also refer to FIG. 19) and a longitudinal axis 514. In the shown embodiment pivot pin 512 is captivity connected to lugs 530 thereby facilitating the disassembly and re-assembly of gun 500.

Figure 4:
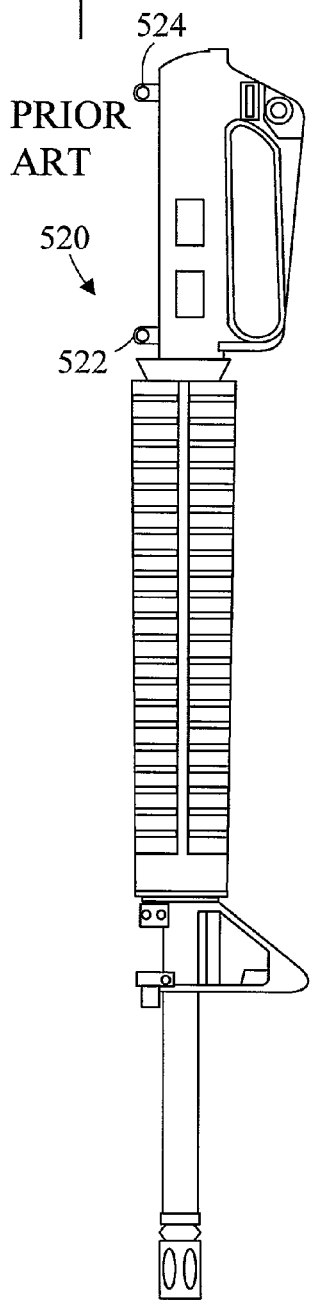
FIG. 4 is right side elevation view of a prior art upper receiver.
Figure 5:
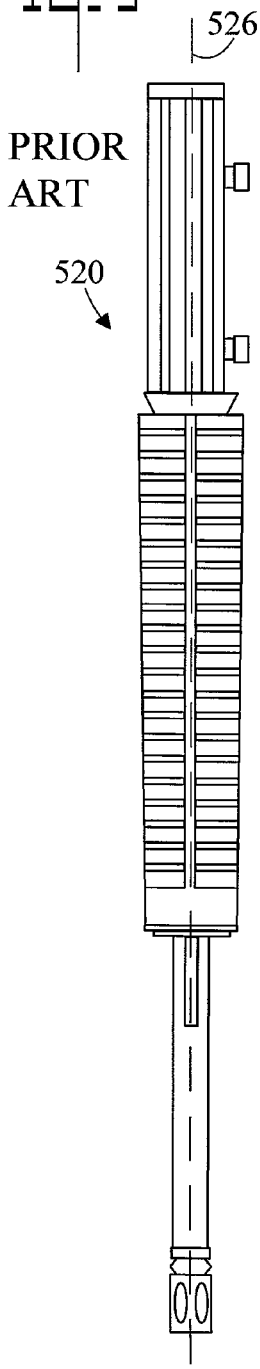
FIG. 5 is a top plan view of the prior art upper receiver.
Figure 6:
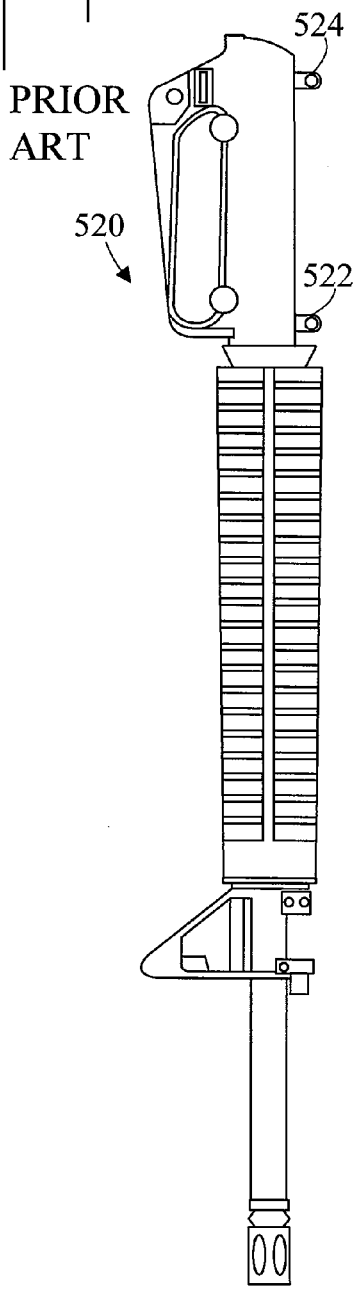
FIG. 6 is a left side elevation view of the prior art upper receiver.

FIGS. 4-6 are right side elevation, top plan, and left side elevation views respectively of upper receiver and barrel assembly 520, which includes a pivot pin lug 522, a takedown pin lug 524, and a longitudinal axis 526. It is noted that when gun 500 is assembled, pivot pin lug 522 is engaged by pivot pin 512 of lower receiver and buttstock assembly 510.

It is noted that lower receiver and buttstock assembly 510 and upper receiver and barrel assembly 520 can be broken down into various sub-elements. For example the buttstock can be removed from lower receiver and buttstock assembly 510, the hand guards removed from upper receiver and barrel assembly 520, etc. The present invention can accommodate various configurations of lower receiver and buttstock assembly 520 and upper receiver and barrel assembly 520 sub-elements. As such, for the purposes of the following description, a lower receiver 510A and an upper receiver 520A are defined herein. Lower receiver 510A includes various combinations of lower receiver and buttstock assembly 510 sub-elements which include pivot pin 512 and spaced apart lugs 530. Upper receiver 520A includes various combinations of upper receiver and barrel assembly 520 sub-elements which include pivot pin lug 522. However for the embodiment of FIGS. 34 and 35, upper receiver 520A also must include takedown pin lug 524.

Figure 7:
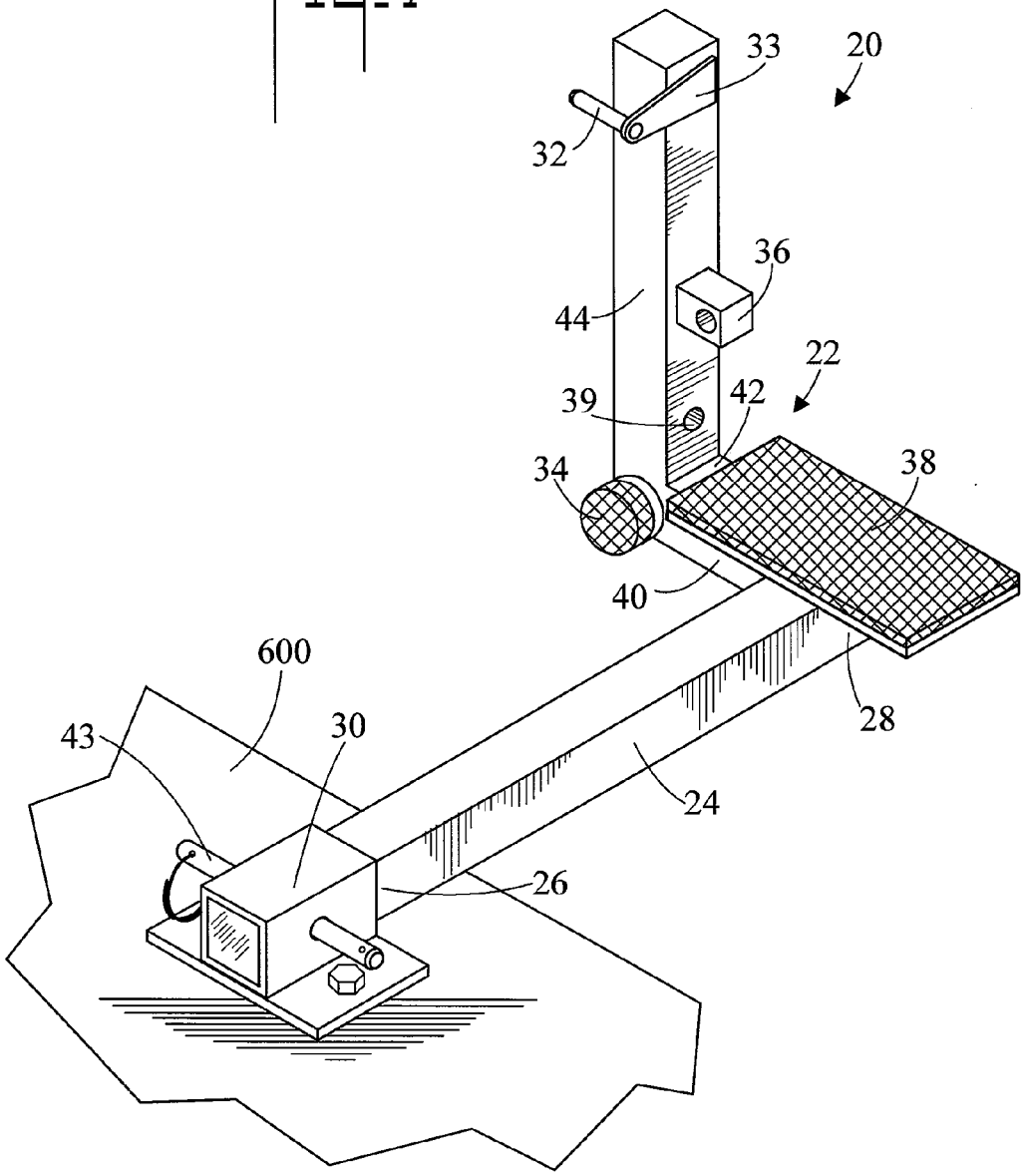
FIG. 7 is an enlarged perspective view of an apparatus for holding the gun.
Figure 8:
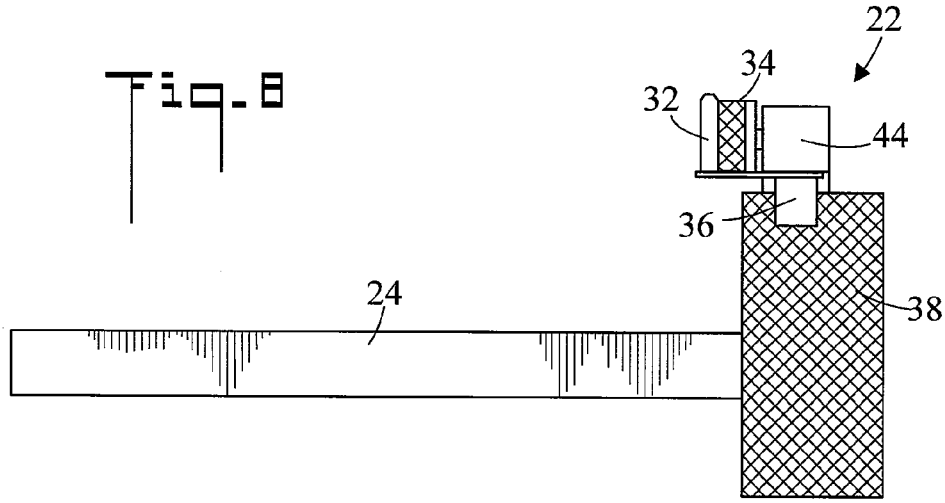
FIG. 8 is an enlarged top plan view of a gun holder.
Figure 9:
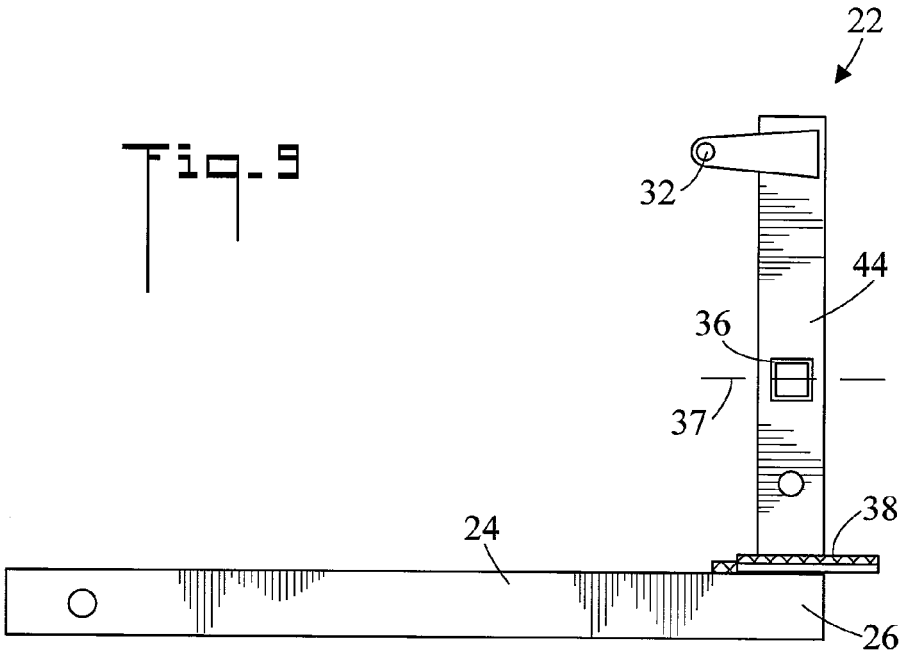
FIG. 9 is an enlarged side elevation view of the gun holder.

FIG. 7 is an enlarged perspective view of an apparatus for holding gun 500, generally designated as 20. Apparatus 20 cooperates with a support member 600 such as a workbench, desk, table, or other stable structure. Support member 600 must be rigid enough to support the weight of gun 500. Apparatus 20 includes a gun holder 22 which includes a support beam 24 having a proximal end 26 and an opposite distal end 28. Proximal end 26 of support beam 24 is connectable to support member 600 so that support beam 24 is horizontally cantilevered from support member 600. In the shown embodiment, apparatus 20 includes an anchor 30 which is connectable to support member 600, anchor 30 is shaped and dimensioned to removably receive and hold proximal end 26 of support beam 24. In the shown embodiment anchor 30 is a fitting which is fixedly attached to support member 600. However, it may be appreciated that anchor 30 can be any device which can connect support beam 24 to support member 600. For example anchor 30 could be a C-clamp which connects support beam 24 to a workbench, a bumper or other portion of a motor vehicle, a work table, etc.

Gun holder 22 further includes an upper receiver attachment pin 32 which is shaped and dimensioned to connect to pivot pin lug 522 of upper receiver 520A of gun 500 (refer also to FIG. 24). Upper receiver attachment pin 32 is connected to second arm 44 by a bracket 33. When support beam 24 is so connected to support member 600 and pivot pin lug 522 is connected to upper receiver attachment pin 32, upper receiver 520A hangs from upper receiver attachment pin 32

(refer also to FIGS. 22, 23, 28, and 29). Gun holder 22 further includes an upper receiver bumper 34 which abuts upper receiver 520A when pivot pin lug 522 is connected to upper receiver attachment pin 32 (refer also to FIG. 28). In the shown embodiment upper receiver bumper 34 is padded so as not to mar or damage upper receiver 520A.

Gun holder 22 further includes a lower receiver attachment lug 36 which is shaped an dimensioned to connect to pivot pin 512 (also refer to FIGS. 17-21). Gun holder 22 also includes a platform 38 which horizontally supports lower receiver 510A when pivot pin 512 is connected to lower receiver attachment lug 36, so that longitudinal axis 514 of lower receiver 510A is horizontally disposed (refer also to FIG. 18). In the shown embodiment platform 38 is padded so as not to mar or damage lower receiver 510A. It is noted that upper receiver attachment pin 32 and lower receiver attachment lug 36 are connected to support bar 24 via first arm 40 and second arm 44. Gun holder 22 further includes an accessory port 39 which allows the user to insert or hang attachments which are used for cleaning or inspecting gun 500. Such attachments include lights, cleaning brushes, cleaning rods, and patch trays. In FIGS. 31-34, accessory port 39 is used to pivotally connect a swing arm 62 which allows upper receiver 520A to be positioned horizontally.

Figure 10:
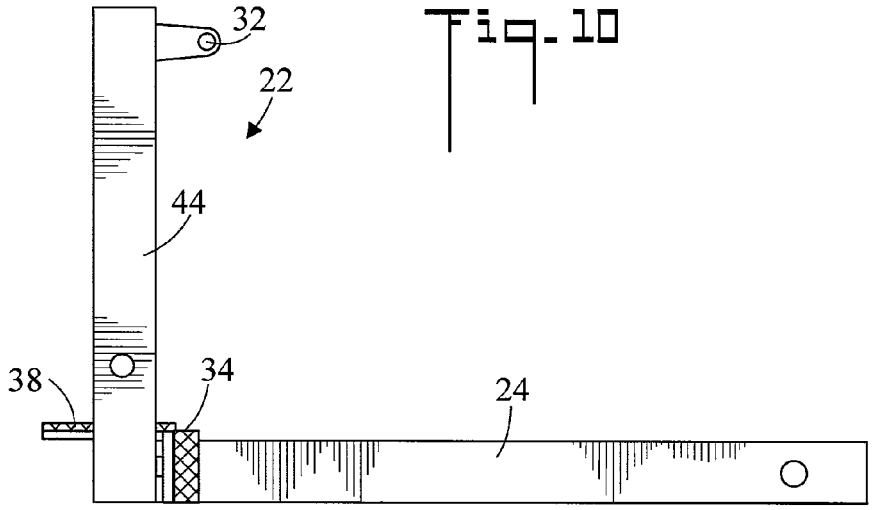
FIG. 10 is an enlarged opposite side elevation view of the gun holder.
Figure 11:
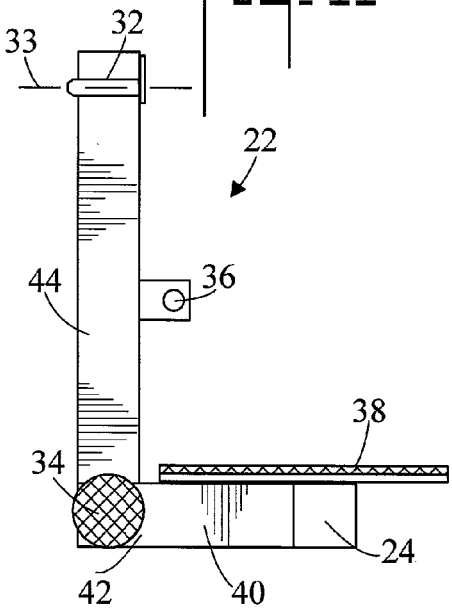
FIG. 11 is an enlarged front elevation view of the gun holder.
Figure 12:
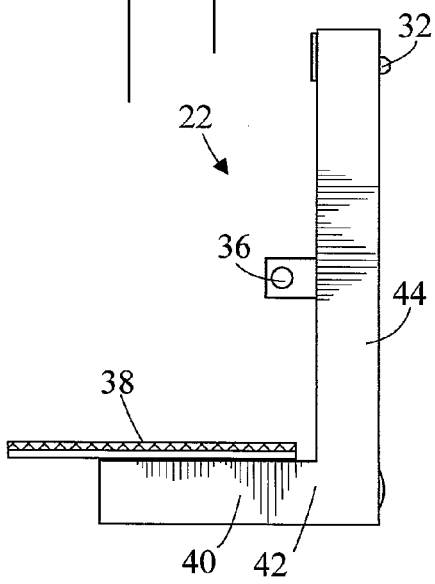
FIG. 12 is an enlarged rear elevation view of the gun holder.
Figure 13:
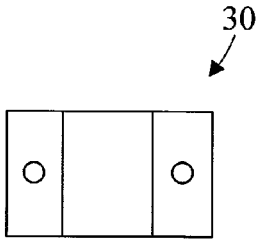
FIG. 13 is an enlarged top plan view of an anchor.
Figure 15:
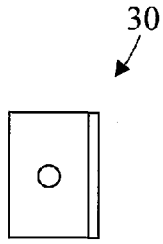
FIG. 15 is an enlarged side elevation view of the anchor.
Figure 14:
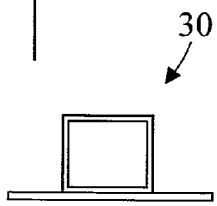
FIG. 14 is an enlarged end elevation view of the anchor.
Figure 16:
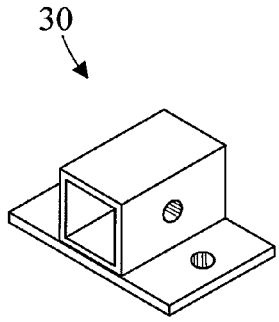
FIG. 16 is an enlarged perspective view of the anchor.

FIGS. 8-12 are enlarged top plan, enlarged side elevation, enlarged opposite side elevation, enlarged front, and enlarged rear views respectively of gun holder 22. Also referring to FIG. 7, a first arm 40 is connected to distal end 28 of support beam 24. First arm 40 is disposed perpendicular to support beam 24 and has a distal end 42. A second arm 44 is connected to distal end 42 of first arm 40. Second arm 44 is disposed perpendicular to first arm 40 and is disposed perpendicular to support beam 24 (as shown in FIG. 10). It is noted that when support beam 24 is connected to and cantilevered from support member 600 as in FIG. 7, second arm 44 is disposed vertically. In the shown embodiment, both upper receiver attachment pin 32 and lower receiver attachment lug 36 are disposed on second arm 44, with upper receiver attachment pin 32 being above lower receiver attachment lug 36. It is further noted that an axis 33 of upper receiver attachment pin 32 and axis 37 of lower receiver attachment lug 36 are both horizontally disposed (refer to FIGS. 11 and 9 respectively). Also, upper receiver bumper 34 is disposed on second arm 44, and platform 38 is disposed on first arm 40. It is noted that the names of the views shown in FIGS. 8-12 are all used in subsequent figures.

FIGS. 13-16 are enlarged top plan, enlarged end elevation, enlarged side elevation, and enlarged perspective views respectively of anchor 30. Also referring to FIG. 7, in the shown embodiment anchor 30 is attached by bolts to support member 600, and is shaped and dimensioned to receive distal end 26 of support beam 24. In the shown embodiment, a detent pin 43 (refer to FIG. 7) is utilized to removably lock support beam 24 to anchor 30.

Figure 17:
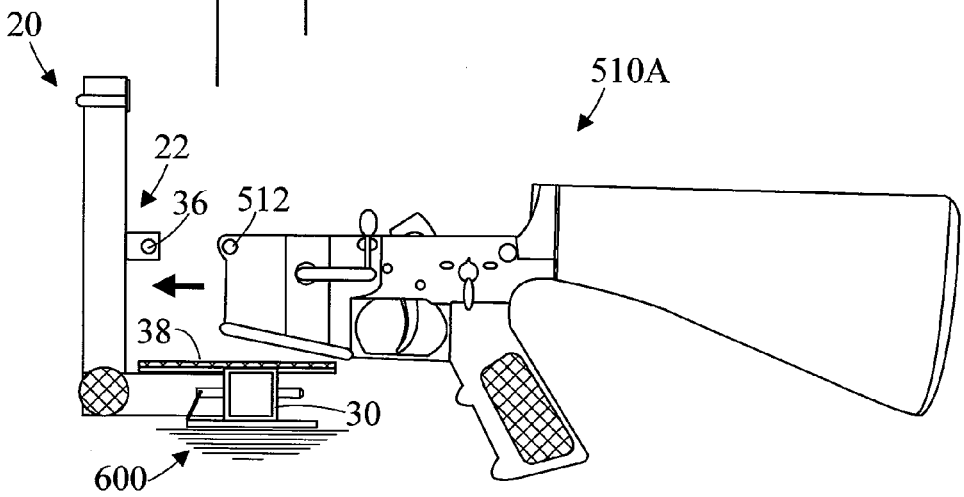
FIG. 17 is a front elevation view of the apparatus with the lower receiver positioned to be connected thereto.
Figure 18:
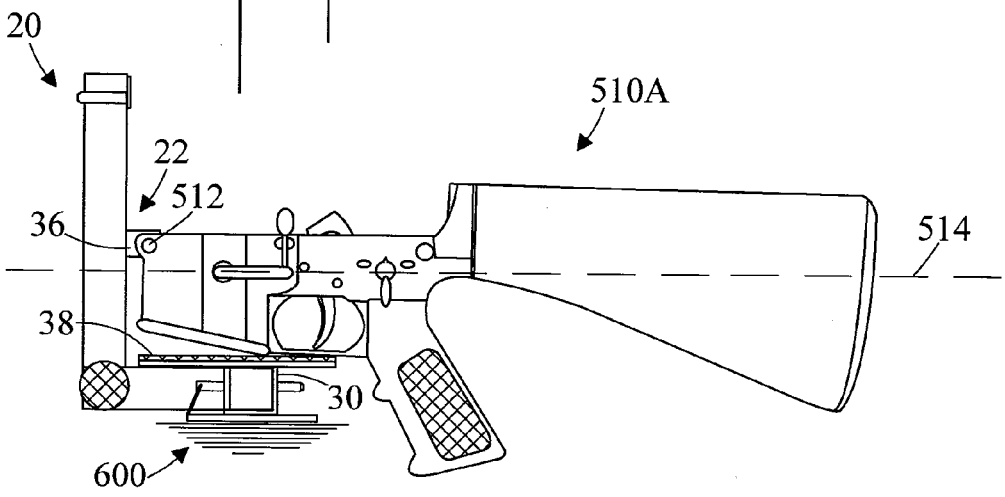
FIG. 18 is a front elevation view of the apparatus with the lower receiver connected.

FIG. 17 is a front elevation view of apparatus 20 with lower receiver 510A positioned to be connected thereto, and FIG. 18 is a front elevation view of apparatus 20 with lower receiver 510A connected. It is noted that as shown lower receiver 510A includes all of the sub-elements of lower receiver and buttstock assembly 510 (refer to FIGS. 2 and 3). However, lower receiver could also comprise only a portion of the sub-elements so long as pivot pin 512 is included. In FIG. 17 pivot pin 512 of lower receiver 510A is moved toward lower receiver attachment lug 36. In FIG. 18, lower receiver attachment lug 36 has received pivot pin 512, and lower receiver 510A is supported by platform 38 so that longitudinal axis 514 is horizontal. As such, lower receiver 510A is firmly held in place by gun holder 22 of apparatus 20, thereby allowing inspection, cleaning, and other maintenance activities to be performed. Also shown are anchor 30 and support member 600.

FIGS. 19-29 are fragmented perspective and fragmented top plan views respectively of lower receiver 510A being connected to apparatus 20. Pivot pin 512 passes through two spaced apart lugs 530 of lower receiver 510A and lower receiver attachment lug 36 of gun holder 22, thereby holding lower receiver 510A in place.

Figure 21:
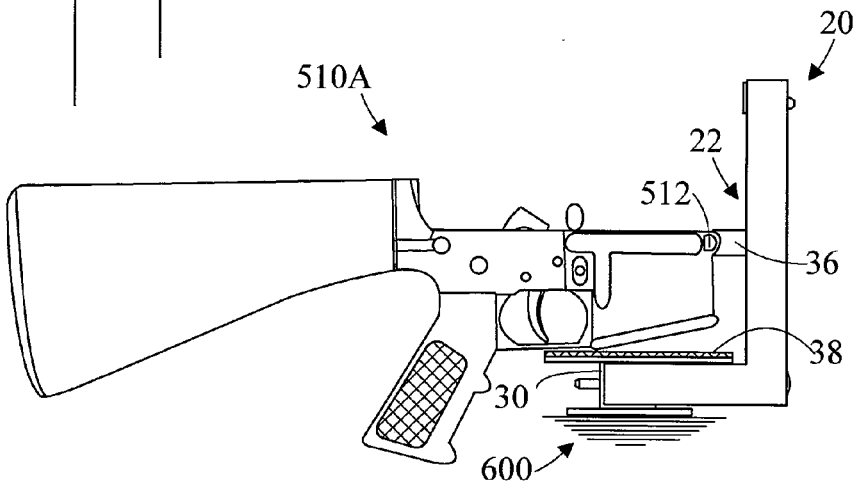
FIG. 21 is a rear elevation view of the apparatus with the lower receiver connected.

FIG. 21 is a rear elevation view of apparatus 20 with lower receiver 510A connected. Shown are lower receiver 510A, gun holder 22, anchor 30, support member 600, pivot pin 512, lower receiver attachment lug 36, and platform 38.

FIG. 22 is a front elevation view of apparatus 20 with upper receiver 520A positioned to be connected thereto, FIG. 23 is a front elevation view of apparatus 20 with upper receiver 520A connected, and FIG. 24 is a fragmented perspective view of upper receiver 520A being connected to apparatus 20. It is noted that as shown upper receiver 520A includes all of the sub-elements of upper receiver and barrel assembly 520 (refer to FIGS. 4 and 6). However, upper receiver 520A could also comprise only a portion of the sub-elements so long as pivot pin lug 522 is included. In FIG. 22 pivot pin lug 522 (also refer to FIG. 24) is moved toward upper receiver attachment pin 32. In FIG. 23, upper receiver attachment pin 32 has been receiver by pivot pin lug 522 and upper receiver 520A hangs (is suspended) barrel down from upper receiver attachment pin 32 (also refer to FIGS. 28 and 29). It is noted that cantilevered support beam 24 permits upper receiver 520A to freely hang down past support member 600 (also refer to FIG. 7). In an embodiment, the longitudinal axis 526 of upper receiver 520 is vertical. As such, upper receiver 520A is held in place by gun holder 22 of apparatus 20, thereby allowing inspection, cleaning, and other maintenance activities to be performed. Also shown are anchor 30 and support member 600.

Figure 25:
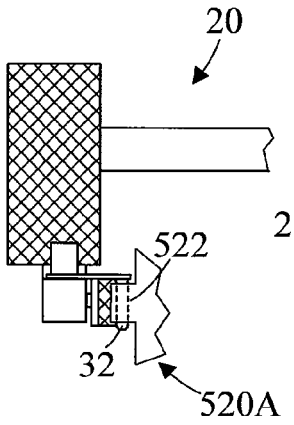
FIG. 25 is a fragmented top plan view of the apparatus with the upper receiver connected.

FIG. 25 is a fragmented top plan view of apparatus 20 with upper receiver 520A connected. Shown are upper receiver attachment pin 32, and pivot pin lug 522.

Figure 26:
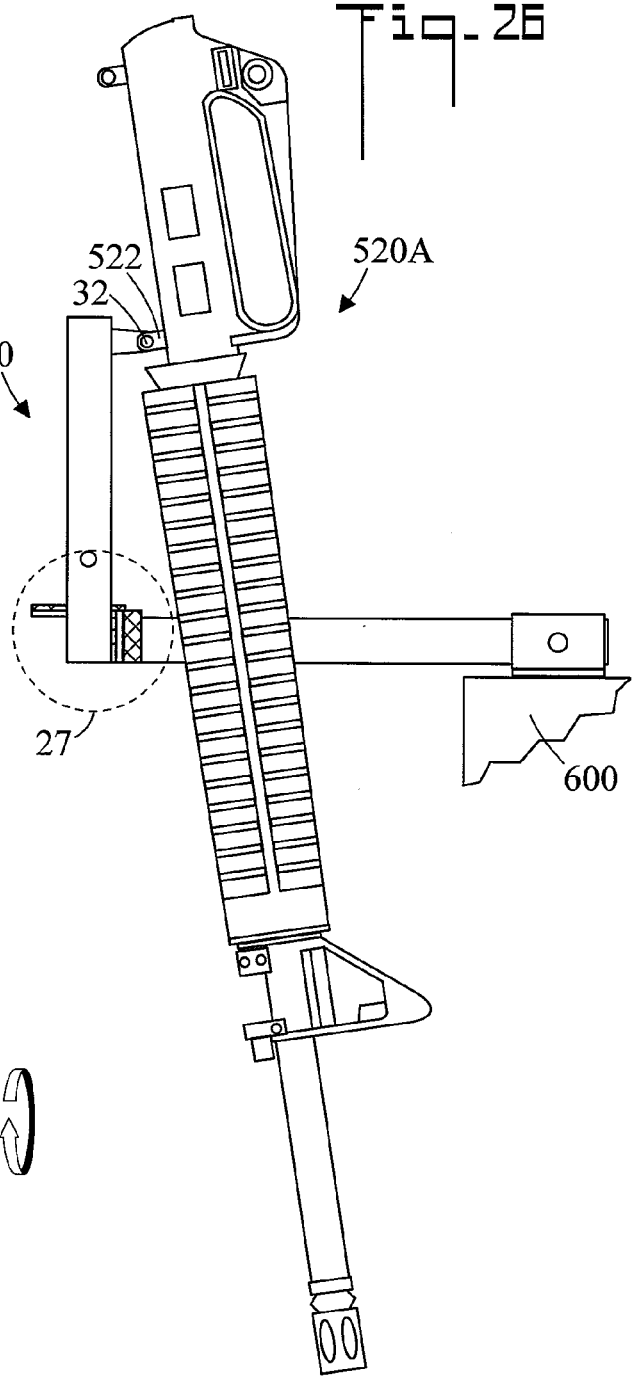
FIG. 26 is an opposite side elevation view of the apparatus with the upper receiver being connected.

FIG. 26 is an opposite side elevation view of apparatus 20 with upper receiver 520A being connected. As shown upper receiver 520A is at an angle, however once pivot pin lug 522 is connected to attachment pin 32, gravity causes upper receiver 520A to assume the downward position of FIG. 28.

Figure 27:
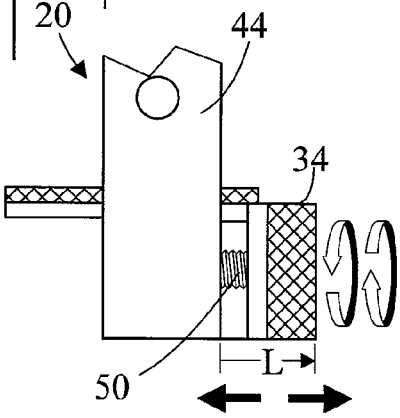
FIG. 27 is a view of area 27 of FIG. 26.

FIG. 27 is a view of area 27 of FIG. 26. Upper receiver bumper 34 has an adjustable length L. That is, the face of upper receiver bumper 34 can be selectively moved a distance L from second arm 44. In the shown embodiment the movement of upper receiver bumper 34 is effected by a screw 50. This adjustment changes the angular position of longitudinal axis 526 of upper receiver 520A with respect to vertical (also refer to FIG. 28).

Figure 28:
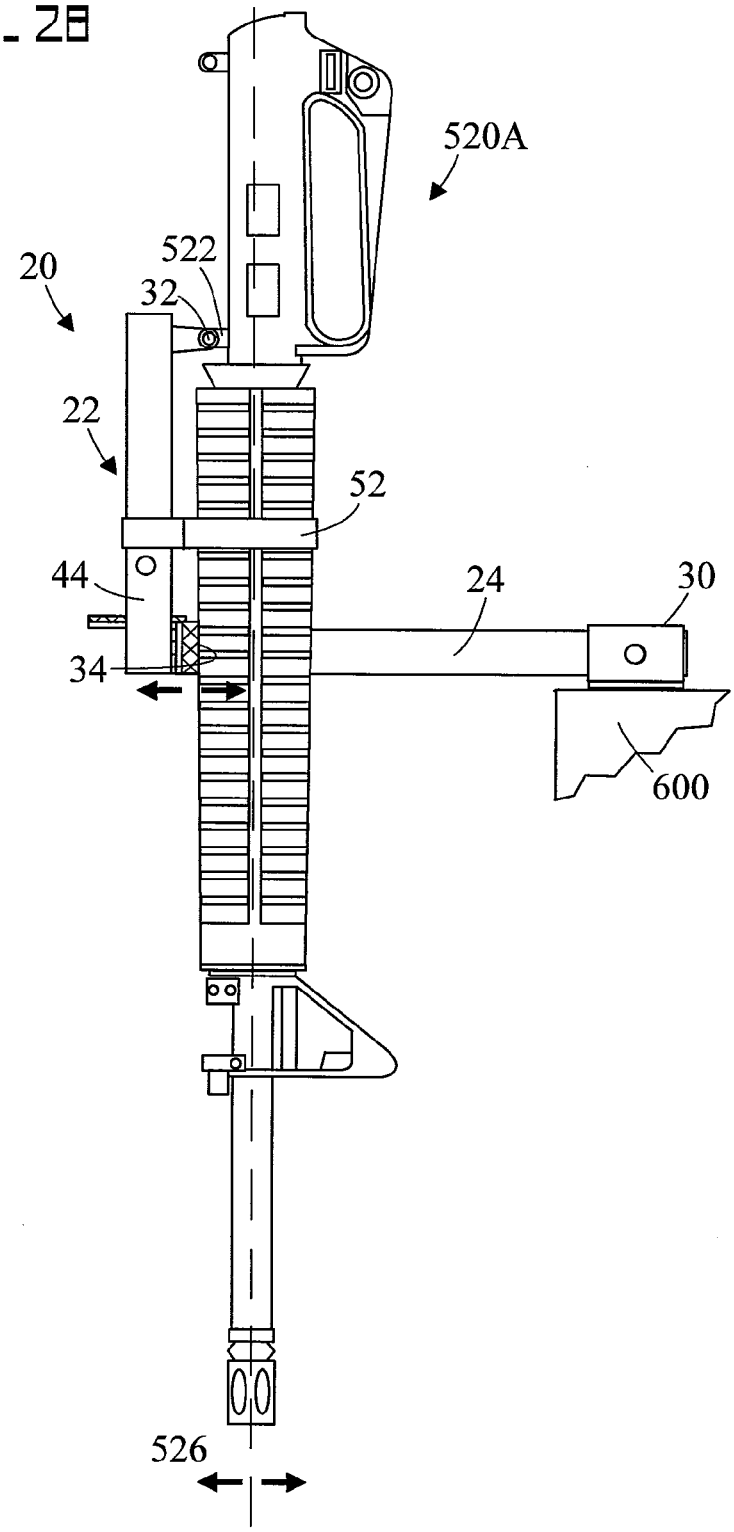
FIG. 28 is an opposite side elevation view of the apparatus with the upper receiver in a vertical orientation.

FIG. 28 is an opposite side elevation view of apparatus 20 with upper receiver 520A in a vertical orientation. Upper receiver bumper 34 has been adjusted so that longitudinal axis 526 of upper receiver 520A is approximately vertical, which is a useful position for inspection, cleaning, and maintenance activities. Adjustable upper receiver bumper 34 is useful in accommodating different size handguards of upper receiver 520A. A strap 52 can be used to hold upper receiver 520A to second arm 44 of gun holder 22. In an embodiment, strap 52 is fashioned from hook-and-loop material. Also shown are support beam 24, anchor 30, and support member 600. It may be appreciated that in another possible embodiment, take down pin lug 524 (refer to FIGS. 4 and 6) rather than pivot pin lug 522 can be connected to upper receiver attachment pin 32 so that upper receiver 520A hangs lower in gun holder 22.

Figure 29:
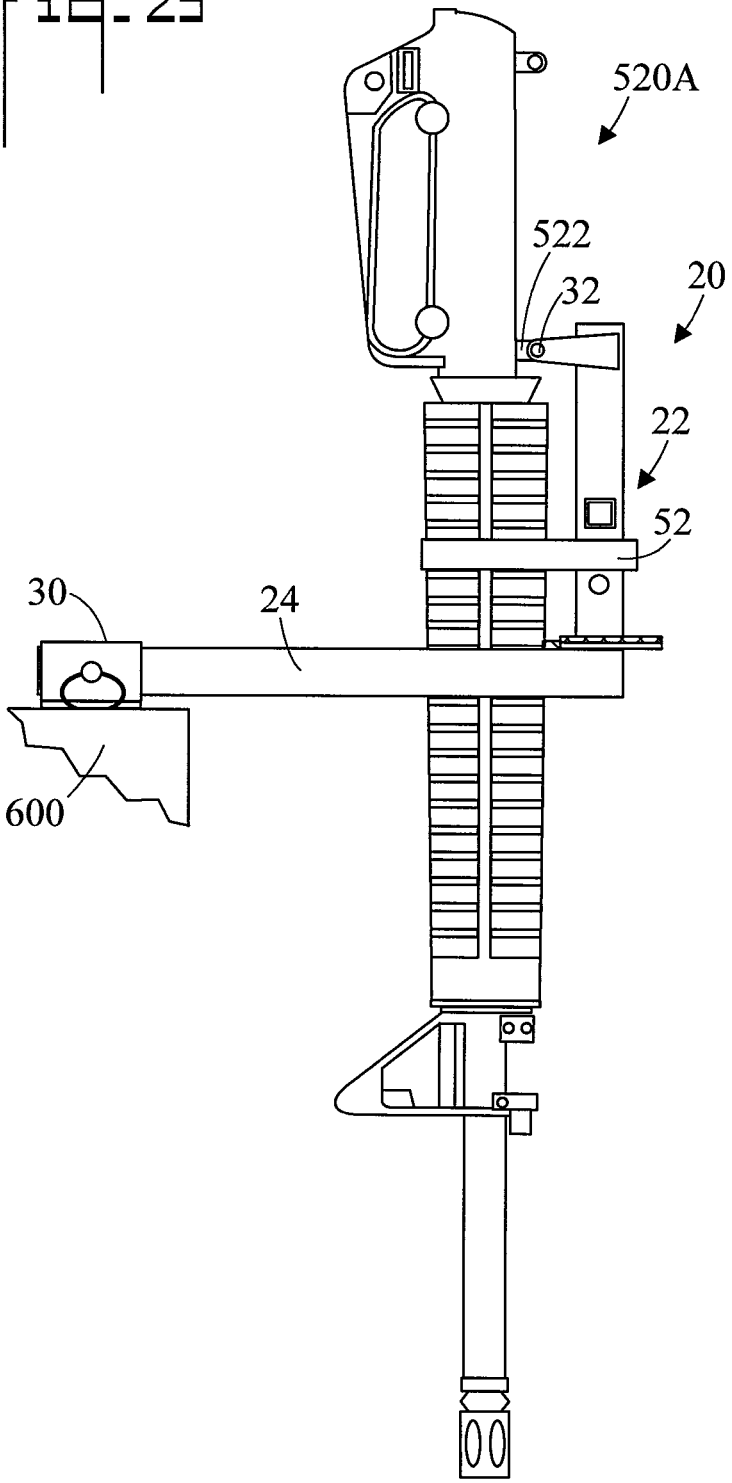
FIG. 29 is a side elevation view of the apparatus with the upper receiver connected.

FIG. 29 is a side elevation view of apparatus 20 with upper receiver 520A connected. Also shown are upper receiver attachment pin 32, pivot pin lug 522, support beam 24, strap 52, anchor 30, and support member 600.

Figure 30:
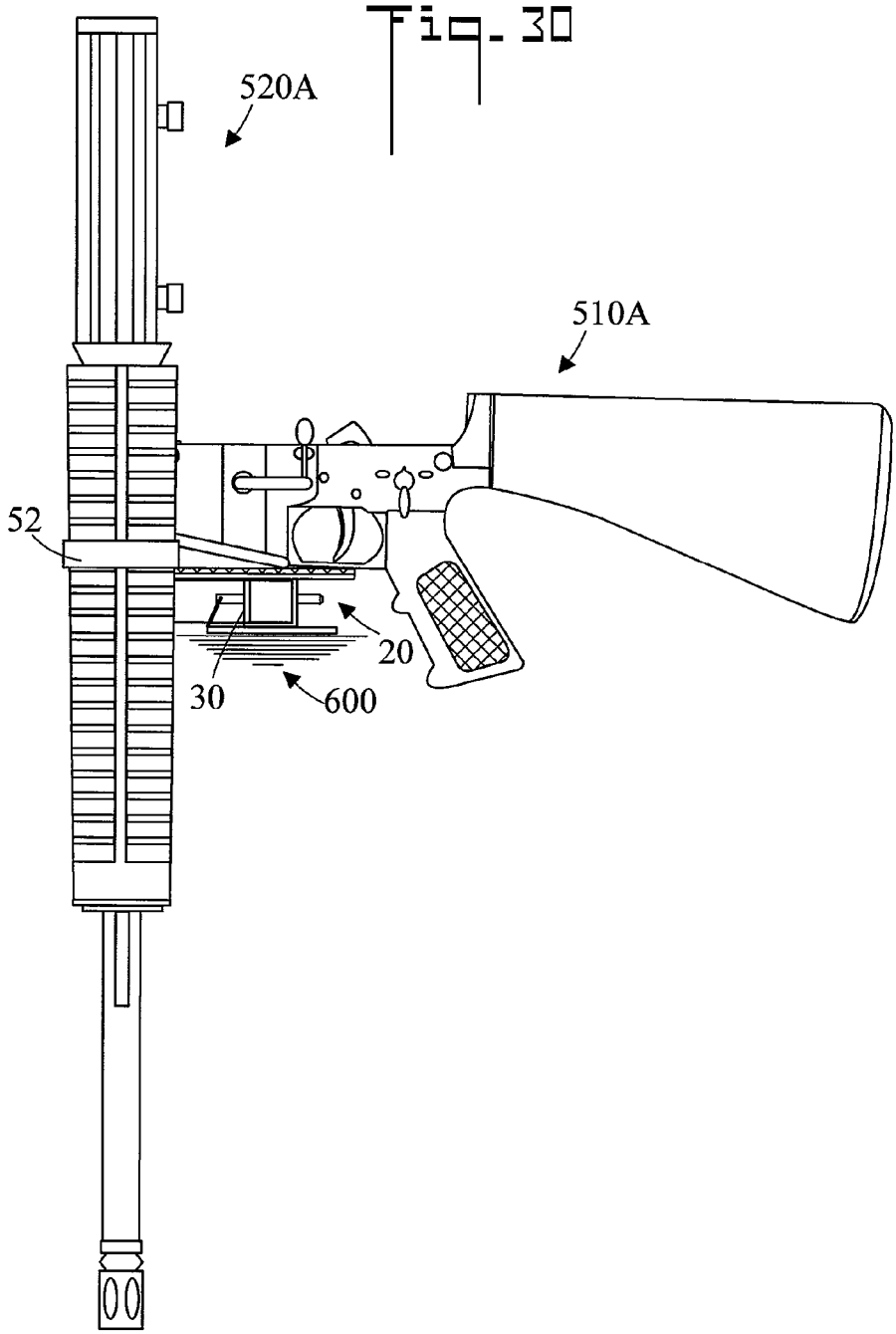
FIG. 30 is a front elevation view of the apparatus with both the upper receiver and lower receiver connected.

FIG. 30 is a front elevation view of apparatus 20 with both upper receiver 520A and lower receiver 510A simultaneously connected to apparatus 20. Also shown are strap 52, anchor 30, and support member 600. It may be appreciated that upper receiver 520A and lower receiver 510A can also be separately connected to apparatus 20 as is shown in FIGS. 29 and 18 respectively.

Figure 31:
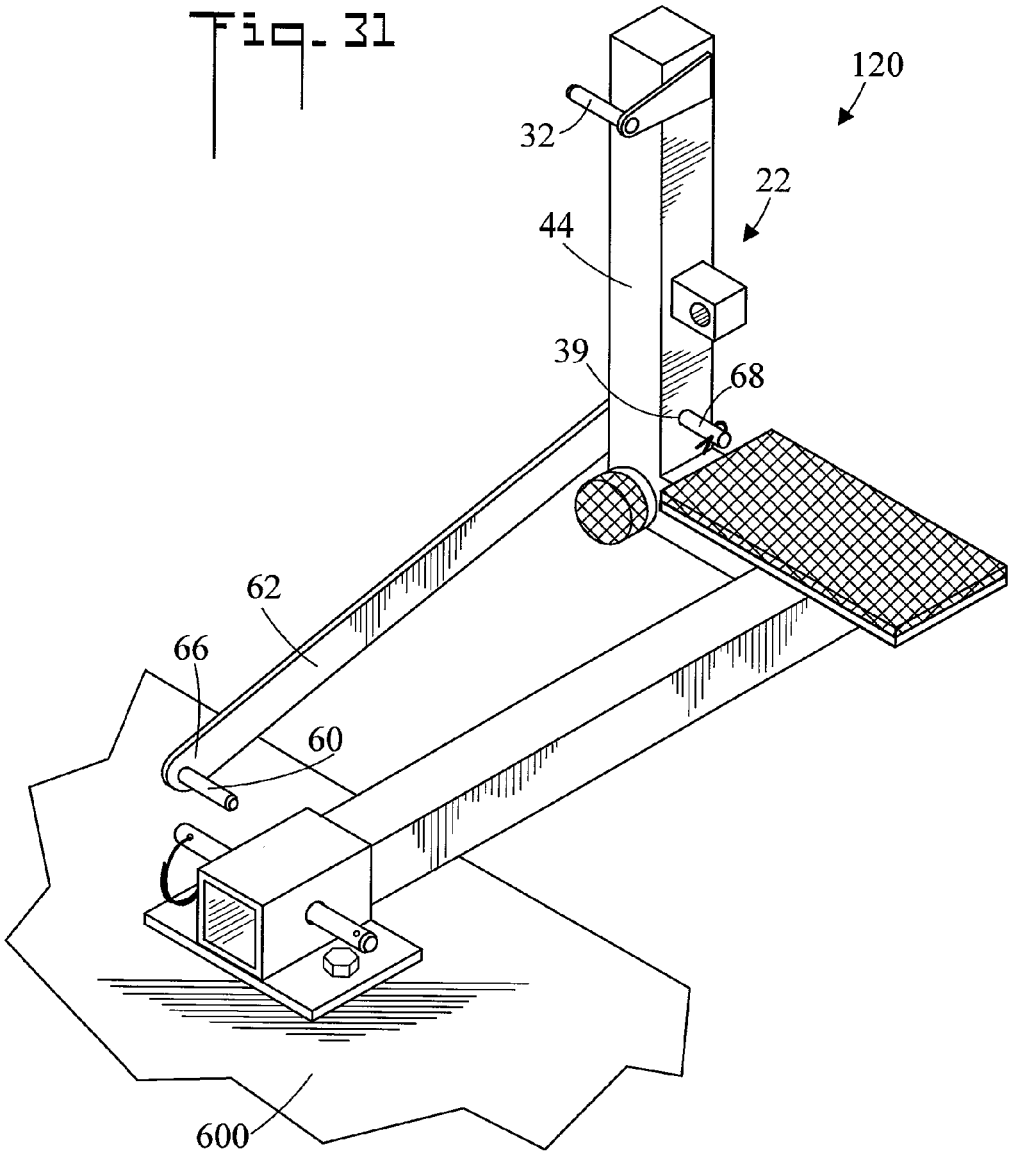
FIG. 31 is an enlarged perspective view of a second embodiment of the apparatus.
Figure 32:
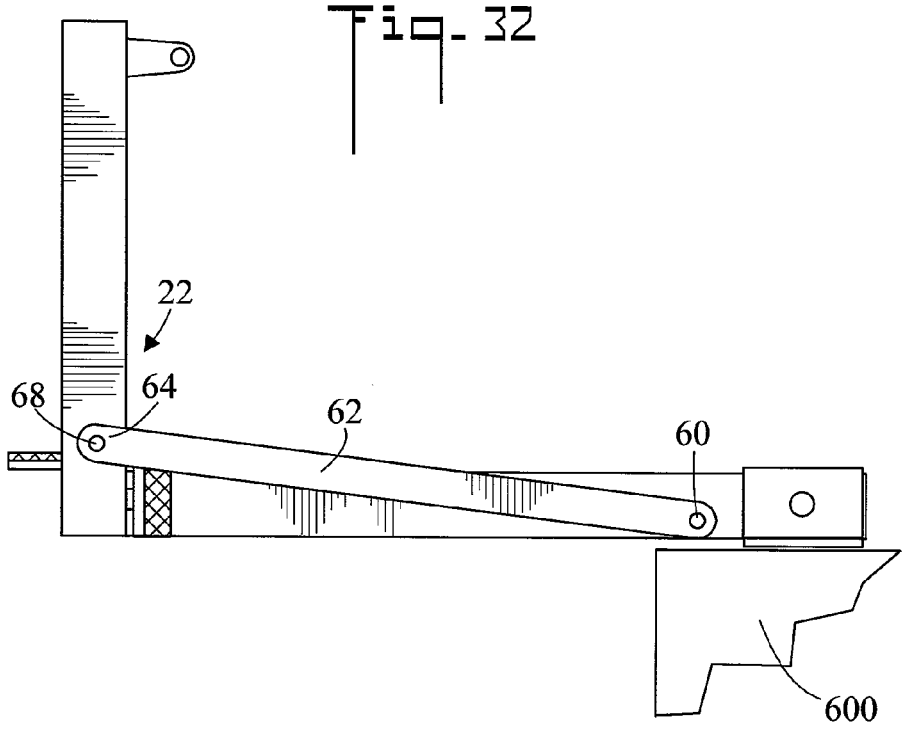
FIG. 32 is an opposite side elevation view of the second embodiment apparatus.
Figure 33:
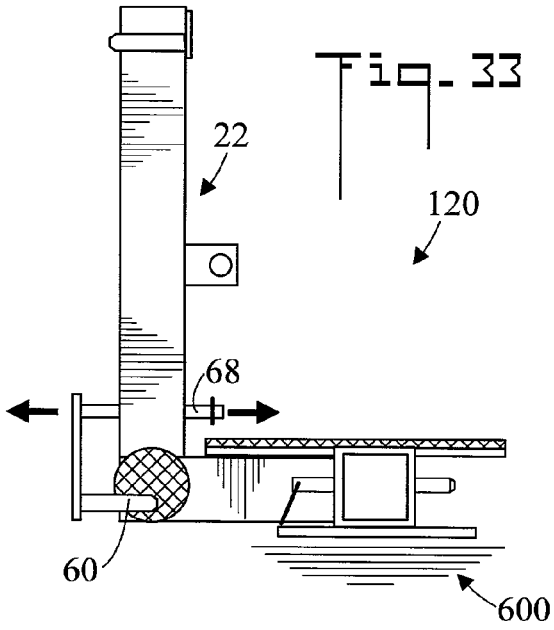
FIG. 33 is a front elevation view of the second embodiment apparatus.
Figure 34:
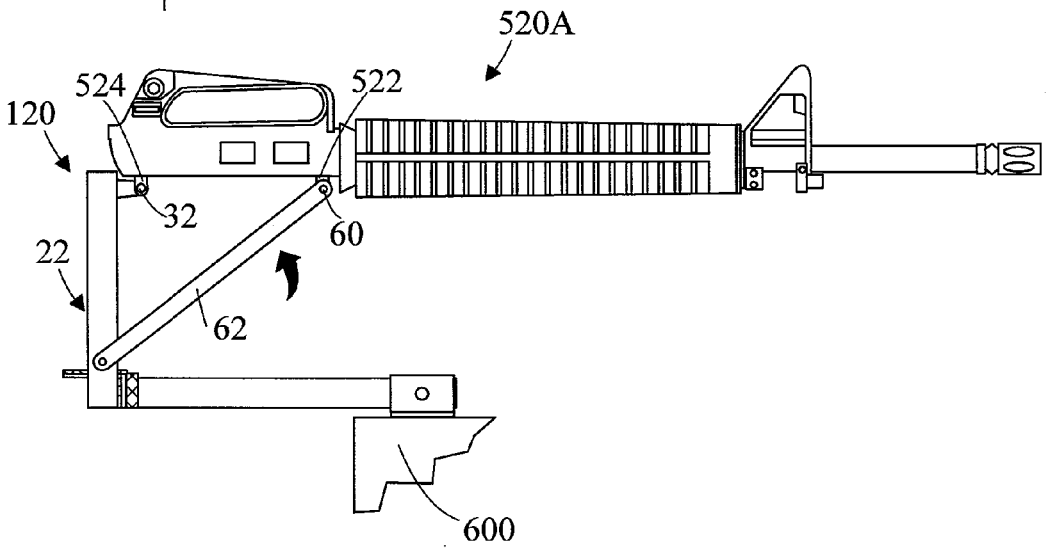
FIG. 34 is an opposite side elevation view of the second embodiment apparatus with the upper receiver connected thereto; and, FIG. 35 is an opposite side elevation view of the second embodiment apparatus with the upper receiver connected in a different manner.

FIGS. 31-33 are enlarged perspective, enlarged opposite side elevation, and enlarged front elevation views of a second embodiment of apparatus 120. FIG. 34 is an opposite side elevation view of the second embodiment of the apparatus 120 with upper receiver 520A connected thereto. Second embodiment apparatus 120 is identical to apparatus 20 except that apparatus 120 includes an additional feature. Gun holder 22 of apparatus 120 includes a second upper receiver attachment pin 60 which is shaped and dimensioned to connect to pivot pin lug 522, or to connect to takedown pin lug 524. Second embodiment apparatus 120 includes a swing arm 62 which has a proximal end 64 and an opposite distal end 66. Proximal end 64 is pivotally connected to second arm 44 by a swing arm pivot pin 68 which is inserted in accessory port 39. Second upper receiver attachment pin 60 is connected to distal end 66 of swing arm 62. Referring specifically to FIG. 34, pivot pin lug 522 can be connected to second upper receiver attachment pin 60, and takedown pin lug 524 can be connected to upper receiver attachment pin 32, thereby holding upper receiver 520A in a horizontal position. In FIG. 33 it is noted that swing arm pivot pin 68 can be longitudinally moved within accessory port 39 (refer to FIG. 7) to facilitate the insertion of second upper receiver attachment pin 60 into takedown pin lug 524.

Figure 35:
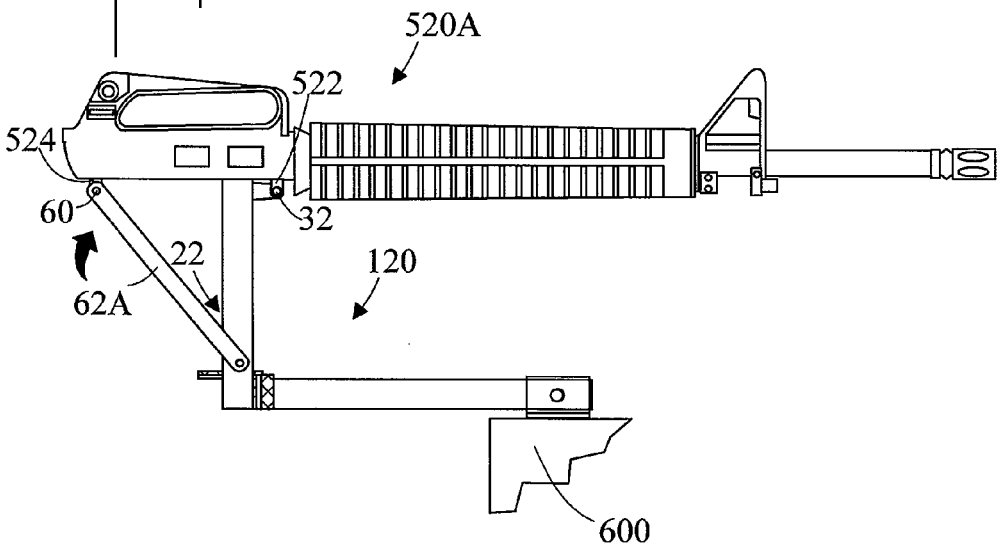

FIG. 35 is an opposite side elevation view of the second embodiment apparatus 120 with upper receiver 520A connected in a different manner. In this version, pivot pin lug 522 is connected to upper receiver attachment pin 32, and takedown pin lug 524 is connected to second upper receiver attachment pin 60, thereby holding upper receiver 520A in a horizontal position. To effect this connection, a shorter swing arm 62A must be utilized. In view of FIGS. 34 and 35, it is noted that pivot pin lug 522 can be connected to one of upper receiver attachment pin 32 and second upper receiver attachment pin 60, and that takedown pin lug 524 can be connected to the other of upper receiver attachment pin 32 and second upper receiver attachment pin 60, wherein upper receiver 520A is held in a horizontal position.

Referring to FIG. 7, in the shown embodiment apparatus 20 is fabricated from small diameter square metal tubing which is welded together. Platform 38, upper receiver attachment pin 32, lower receiver attachment lug 36, and upper receiver bumper 34 are fashioned from assorted metal products and either welded or threaded to gun holder 22. Anchor 30 is also made of metal tubing and a flat metal strap which attached to support member 600. It may be appreciated however that apparatus 20 could be constructed from other materials including wood, plastics or composites.

In terms of use, a method for holding a gun 500 includes: (refer to FIGS. 1-35)

(a) providing a gun 500 having an upper receiver 520A which has been separated from a lower receiver 510A, upper receiver 520A having a pivot pin lug 522;

(b) providing a support member 600;

(c) providing an apparatus 20 for holding gun 500, apparatus 20 including a gun holder 22 which includes a support beam 24 having a proximal end 26 and an opposite distal end 28, and an upper receiver attachment pin 32 which is shaped and dimensioned to be received by pivot pin lug 522, (d) connecting proximal end 26 of support beam 24 to support member 600 so that support beam 24 is horizontally cantilevered from support member 600; and, (e) connecting pivot pin lug 522 to upper receiver attachment pin 32 wherein upper receiver 520A hangs from upper receiver attachment pin 32.

The method further including:

in (c) gun holder 22 including an upper receiver bumper 34; and, in (e), upper receiver 520A abutting upper receiver bumper 34.

The method further including:

in (a), upper receiver 520A having a longitudinal axis 526 which assumes an angular position with respect to vertical in (e);

in (c), upper receiver bumper 34 having an adjustable length L, which when adjusted changes the angular position of longitudinal axis 526 of upper receiver 520A; and, after (e), adjusting length L of upper receiver bumper 34 so that longitudinal axis 526 of upper receiver 520A is approximately vertical.

The method further including:

in (c), providing an anchor 30 which is connectable to support member 600, anchor 30 shaped and dimensioned to removably receive hold proximal end 26 of support beam 24; and, in (d), using anchor 30 to connect proximal end 26 of support beam 24 to support member 600.

The method further including:

in (c), providing a strap 52 for connecting upper receiver 520A to gun holder 22; and, after (e), using strap 52 to connect upper receiver 520A to gun holder 22.

The method further including:

in (a), lower receiver 520A having a pivot pin 512 and a longitudinal axis 514;

in (c), gun holder 22 including a lower receiver attachment lug 36 which is shaped an dimensioned to connect to pivot pin 512; and, (f) connecting pivot pin 512 to lower receiver attachment lug 36.

The method further including:

in (c)) gun holder 22 including a platform 38 which is shaped and dimensioned to horizontally support lower receiver 510A; and, in (f), platform 38 supporting lower receiver 510A so that longitudinal axis 514 of lower receiver 510A is horizontally disposed.

In the method described above upper receiver 520A is connected to apparatus 20 before lower receiver 510A is connected. It may be appreciated however that the order could be reversed with lower receiver 520A connected before upper receiver 510A. To that end, a method for holding a gun 500 includes: (refer to FIGS. 1-34)

(a) providing a gun 500 having a lower receiver 510A which has been separated from an upper receiver 520A, lower receiver 510A having a pivot pin 512;

(b) providing a support member 600;

(c) providing an apparatus 20 for holding gun 500, apparatus 20 including a gun holder 22 which includes a support beam 24 having a proximal end 26 and an opposite distal end 28, and a lower receiver attachment lug 36 which is shaped and dimensioned to receiver pivot pin 512, (d) connecting proximal end 26 of support beam 24 to support member 600 so that support beam 24 is horizontally cantilevered from support member 600; and, (e) connecting pivot pin 512 to lower receiver attachment lug 36. Then proceeding with the connection of upper receiver 520A as described above.

Another method for holding gun 500 includes; (refer to FIGS. 1-35, and most particularly to FIGS. 34 and 35)

(a) providing a gun 500 having an upper receiver 520A which has been separated from a lower receiver 510A, upper receiver 520A having a pivot pin lug 522 and a takedown pin lug 524;

(b) providing a support member 600;

(c) providing an apparatus 20 for holding gun 500, apparatus 20 including a gun holder 22 which includes a support beam 24 having a proximal end 26 and an opposite distal end 28, an upper receiver attachment pin 32 which is shaped and dimensioned to be received by pivot pin lug 522, and a second upper receiver attachment pin 60 which is shaped and dimensioned to be received by takedown pin lug 524, (d) connecting proximal end 26 of support beam 24 to support member 600 so that support beam 24 is horizontally cantilevered from support member 600; and, (e) connecting pivot pin lug 522 to one of upper receiver attachment pin 32 and second upper receiver attachment pin 60, and connecting takedown pin lug 524 to the other of upper receiver attachment pin 32 and second upper receiver attachment pin 60, wherein upper receiver 520A is held in a horizontal position.

The embodiments of the apparatus and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the apparatus and method should be construed as limiting the invention to a particular embodiment or combination of embodiments. The scope of the invention is defined by the appended claims.

I claim:

1. Apparatus for holding a gun, the gun having an upper receiver having a pivot pin lug, the apparatus cooperating with a support member, the apparatus comprising:

a gun holder including a support beam having a proximal end and an opposite distal end, and an upper receiver attachment pin which is shaped and dimensioned to connect to the pivot pin lug; and, said proximal end of said support beam connectable to the support member so that said support beam is horizontally cantilevered from the support member, and when said support beam is so connected to the support member and the pivot pin lug is connected to said upper receiver attachment pin, the upper receiver hangs from said upper receiver attachment pin.

2. The apparatus according to claim 1, further including:

said gun holder including an upper receiver bumper which abuts the upper receiver when the pivot pin lug is connected to said upper receiver attachment pin.

3. The apparatus according to claim 2, the upper receiver having a longitudinal axis, the apparatus further including:

said upper receiver bumper having an adjustable length, which when adjusted changes an angular position of the longitudinal axis of the upper receiver with respect to vertical.

4. The apparatus according to claim 1, further including:

an anchor which is connectable to the support member, said anchor shaped and dimensioned to removably receive and hold said proximal end of said support beam.

5. The apparatus according to claim 1, further including:

a strap for holding the upper receiver to said gun holder.

6. The apparatus according to claim 1, the upper receiver including a takedown pin lug, the apparatus further including:

said gun holder including a second upper receiver attachment pin which is shaped and dimensioned to connect to the takedown pin lug; and, so that the pivot pin lug can be connected to said upper receiver attachment pin, and the takedown pin lug can be connected to said second upper receiver attachment pin, thereby holding the upper receiver in a horizontal position.

7. The apparatus according to claim 1, the gun having a lower receiver having a pivot pin and a longitudinal axis, the apparatus further including:

said gun holder including a lower receiver attachment lug which is shaped an dimensioned to connect to the pivot pin.

8. The apparatus according to claim 7, further including:

said gun holder including a platform which horizontally supports the lower receiver when the pivot pin is connected to said lower receiver attachment lug, so that the longitudinal axis of the lower receiver is horizontally disposed.

9. The apparatus according to claim 7, further including:

a first arm connected to said distal end of said support beam, said first arm disposed perpendicular to said support beam, said first arm having a distal end; and, a second arm connected to said distal end of said first arm, said second arm disposed perpendicular to said first arm and disposed perpendicular to said support beam.

10. The apparatus according to claim 9, further including:

said upper receiver attachment pin disposed on said second arm.

11. The apparatus according to claim 9, further including:

a strap for connecting the upper receiver to said second arm.

12. The apparatus according to claim 9, further including:

an upper receiver bumper which abuts the upper receiver when the pivot pin lug is connected to said upper receiver attachment pin; and, said upper receiver bumper disposed on said second arm.

13. The apparatus according to claim 9, further including:

said lower receiver attachment lug disposed on said second arm.

14. The apparatus according to claim 9, further including:

a platform which horizontally supports the lower receiver when the pivot pin is connected to said lower receiver attachment lug; and, said platform disposed on said first arm.

15. The apparatus according to claim 9, further including:

a swing arm having a proximal end and an opposite distal end;

said proximal end pivotally connected to said second arm; and, said distal end including a second upper receiver attachment pin.

16. An apparatus for holding a gun, the gun having an upper receiver having an pivot pin lug and a lower receiver having a pivot pin, the apparatus cooperating with a support member, the apparatus comprising:

a support beam having a proximal end and an opposite distal end, said proximal end of said support beam connectable to the support member so that said support beam is horizontally cantilevered from the support member;

an upper receiver attachment pin connected to said support beam, said upper receiver attachment pin shaped and dimensioned to connect to the pivot pin lug so that the upper receiver hangs from said upper receiver attachment pin; and, a lower receiver attachment lug connected to said support beam, said lower receiver attachment lug shaped an dimensioned to connect to the pivot pin.

17. A method for holding a gun, comprising:

(a) providing a gun having an upper receiver which has been separated from a lower receiver, said upper receiver having a pivot pin lug;

(b) providing a support member;

(c) providing an apparatus for holding said gun, said apparatus including a gun holder which includes a support beam having a proximal end and an opposite distal end and an upper receiver attachment pin which is shaped and dimensioned to be received by said pivot pin lug, (d) connecting said proximal end of said support beam to said support member so that said support beam is horizontally cantilevered from said support member; and, (e) connecting said pivot pin lug to said upper receiver attachment pin wherein said upper receiver hangs from said upper receiver attachment pin.

18. The method of claim 17, further including:

in (c) said gun holder including an upper receiver bumper; and, in (e), said upper receiver abutting said upper receiver bumper.

19. The method of claim 18, further including:

in (a), said upper receiver having a longitudinal axis which assumes an angular position with respect to vertical in (e);

in (c), said upper receiver bumper having an adjustable length, which when adjusted changes said angular position of said longitudinal axis of said upper receiver; and, after (e), adjusting said length of said upper receiver bumper so that said longitudinal axis of said upper receiver is approximately vertical.

20. The method of claim 17, further including:

in (c), providing an anchor which is connectable to said support member, said anchor shaped and dimensioned to removably receive and hold said proximal end of said support beam; and, in (d), using said anchor to connect said proximal end of said support beam to said support member.

21. The method of claim 17, further including:

in (c), providing a strap for connecting the upper receiver to said gun holder; and, after (e), using said strap to connect said upper receiver to said gun holder.

22. The method of claim 17, further including:

in (a), said lower receiver having a pivot pin and a longitudinal axis;

in (c), said gun holder including a lower receiver attachment lug which is shaped an dimensioned to connect to said pivot pin; and, (f) connecting said pivot pin to said lower receiver attachment lug.

23. The method of claim 22, further including:

in (c)) said gun holder including a platform which is shaped and dimensioned to horizontally support said lower receiver; and, in (f), said platform supporting said lower receiver so that said longitudinal axis of said lower receiver is horizontally disposed.

24. A method for holding a gun, comprising:

(a) providing a gun having an upper receiver which has been separated from a lower receiver, said upper receiver having a pivot pin lug and a takedown pin lug;

(b) providing a support member;

(c) providing an apparatus for holding said gun, said apparatus including a gun holder which includes a support beam having a proximal end and an opposite distal end, an upper receiver attachment pin which is shaped and dimensioned to be received by said pivot pin lug, and a second upper receiver attachment pin which is shaped and dimensioned to be received by said takedown pin lug, (d) connecting said proximal end of said support beam to said support member so that said support beam is horizontally cantilevered from said support member; and, (e) connecting said pivot pin lug to one of said upper receiver attachment pin and said second upper receiver attachment pin, and connecting said takedown pin lug to the other of said upper receiver attachment pin and said second upper receiver attachment pin, wherein said upper receiver is held in a horizontal position.

* * * * *